United States Patent [19]

Nishitani

[11] Patent Number: 5,070,068

[45] **Date of Patent: * Dec. 3, 1991**

[54] HEAT TRANSFER SHEET

[75] Inventor: Nobuhisa Nishitani, Shinjuku, Japan

[73] Assignee: Dai Nippon Insatsu Kabushiki Kaisha, Japan

[ * ] Notice: The portion of the term of this patent subsequent to Nov. 6, 2007 has been disclaimed.

[21] Appl. No.: 570,553

[22] Filed: Aug. 21, 1990

Related U.S. Application Data

[63] Continuation of Ser. No. 305,173, Feb. 2, 1989, Pat. No. 4,968,659.

[30] Foreign Application Priority Data

Feb. 5, 1988 [JP] Japan ..... 63-23760

[51] Int. Cl.[5] ..... B41M 5/035; B41M 5/26

[52] U.S. Cl. ..... 503/227; 8/471; 428/195; 428/447; 428/704; 428/913; 428/914

[58] Field of Search ..... 8/471; 428/195, 447, 428/704, 913, 914; 503/227

[56] References Cited

U.S. PATENT DOCUMENTS 4,740,496 4/1988 Vanier ..... 503/227

FOREIGN PATENT DOCUMENTS 3074693 4/1988 Japan ..... 503/227

*Primary Examiner*—Bruce H. Hess

*Attorney, Agent, or Firm*—Parkhurst, Wendel & Rossi

[57] ABSTRACT

A heat transfer sheet including a dye carrying layer containing a dye which is migrated by heating to be transferred onto an image-receiving material laminated on a substrate film. The dye carrying layer containing a dye-permeative release agent including a modified silicon type compound and/or a phophoric acid ester type surfactant.

6 Claims, No Drawings

HEAT TRANSFER SHEET

This application is a Rule 60 Continuation Application of application Ser. No. 07/305,173, filed Feb. 2, 1989, now U.S. Pat. No. 4,968,659.

BACKGROUND OF THE INVENTION

This invention relates to a heat transfer sheet, more particularly, a heat transfer sheet which is useful in a heat transfer system by use of a sublimable dye (heat migratable dye), excellent in releasability between the dye carrying layer (the dye carrying layer is a layer comprising a dye and a binder; hereinafter called merely as dye layer) and the image-receiving material, and can give a mono-color or full-color image with excellent image density.

As the method capable of giving excellent mono-color or full-color image simply and at high speed in place of general letter printing method or printing method of the prior art, the ink jet system or the heat transfer system have been developed. Among them, as the system capable of giving a full-color image comparable with color photography having excellent continuous tone gradation, the so called sublimation heat transfer system by use of a sublimable dye is superior.

As the heat transfer sheet to be used in the above sublimation type heat transfer system, one having a dye layer containing a sublimable dye formed on one surface of a substrate film such as polyester film, while on the other hand, having a heat-resistant layer provided on the other surface of the substrate film for prevention of sticking of the thermal head, has been generally used.

By superposing the dye layer surface of a heat transfer sheet on an image-receiving material having an image-receiving layer comprising a polyester resin, etc. and heating imagewise the heat transfer sheet from the back surface thereof with a thermal head, the dye in the dye layer is migrated onto the image-receiving material to form a desired image.

In the heat transfer system as described above, since a very high speed heat transfer is demanded, heating with a thermal head is effected for a very short time (msec unit), whereby a high temperature is required for the thermal head.

As the result, when the temperature of the thermal head is elevated, the binder forming the dye layer is softened and sticks to the image-receiving material, whereby there occurs the inconvenience that the heat transfer sheet and the image-receiving material are adhered together, further causing in an extreme case a problem that the dye layer is peeled off during peeling of them to be transferred as such onto the image-receiving material surface.

In the prior art, for avoiding the above problem, there has been proposed a technique to form a curable silicone film separately on the surface of the dye layer (for example, Japanese Laid-open Patent Publication No. 209195/1986). However, in this method, when a curable silicone composition is coated on the dye layer, the solvent component in said composition attacks the dye layer, whereby the problem occurs that the dye is liable to be precipitated on the surface. Also, it is technically difficult to form a curable silicone film with a uniform thickness on the dye layer surface, and coating irregularity is liable to occur inevitably, which may consequently be a factor to cause sensitivity irregularity or formation irregularity of the image.

On the other hand, in the prior art, it has been also proposed to incorporate various release agents such as silicone polymers comprising perfluoroalkylated ester straight or branched alkyl or aryl siloxane units of straight alkyl or polyethyleneoxides or waxes (for example Japanese Laid-open Patent Publication No. 208994/1987). However, according to the knowledge of the present inventor, these release agents are not also necessarily satisfactory in improving releasability during heat transfer.

Accordingly, an object of the present invention is to provide a heat transfer sheet which can give an image of excellent quality without causing such problems as mentioned above.

SUMMARY OF THE INVENTION

The above object can be accomplished by the present invention as described below.

That is, the present invention is a heat transfer sheet comprising a dye carrying layer containing a dye which is migrated by heating to be transferred onto an image-receiving material laminated on a substrate film, characterized in that a specific dye-permeative release agent is contained in the dye carrying layer.

By incorporating a specific release agent as described below in the dye layer of the heat transfer sheet, releasability between the dye layer and the image-receiving material during heat transfer is improved, and an image having excellent image density, light resistance, and contamination resistance can be provided.

DETAILED DESCRIPTION OF THE INVENTION

Referring now to the preferred embodiments, the present invention is described in more detail.

The heat transfer sheet of the present invention comprises basically a dye layer formed on a substrate film similarly as in the prior art technique, but it is characterized by including a dye-permeative release agent in said dye layer.

As the substrate film for the heat transfer sheet of the present invention as described above, any material known in the art having heat resistance and strength to some extent may be employed, such as paper, various converted papers, polyester films, polystyrene films, polypropylene films, polysulfone films, Aramide films, polycarbonate films, polyvinyl alcohol films, Cellophane, etc., having a thickness of 0.5 to 50 μm, preferably 3 to 10 μm, particularly preferably polyester films. These substrate films may be in the form of sheets or continuous films, which are not particularly limited.

The dye layer to be formed on the above substrate film is a layer having a dye carried on any desired binder resin.

As the dye to be employed, any dye which has been used in the heat transfer sheet known in the art can be effectively used in the present invention without any particular limitation. For example, some preferable dyes may include red dyes such as MS Red G, Macrolex Red Violet R, Ceres Red 7B, Samaron Red HBSL or Resolin Red F3BS, yellow dyes such as Holon Brilliant Yellow 6GL, PTY-52 or Macrolex Yellow 6G, and blue dyes such as Kayaset Blue 714, Wacsoline Blue AP-FW, Holon Brilliant Blue S-R or MS Blue 100.

As the binder resin for carrying the dye as described above, any one binder resin known in the art can be used, and preferable examples may include cellulosic resins such as ethyl cellulose, hydroxyethyl cellulose, ethylhydroxy cellulose, hydroxypropyl cellulose, methyl cellulose, cellulose acetate, cellulose acetate butyrate, etc.; vinyl resins such as polyvinyl alcohol, polyvinyl acetate, polyvinyl butyral, polyvinylacetoacetal, polyvinyl pyrrolidone, polyacrylamide, etc.; polyesters; and others. Among them, cellulose type, polyvinyl acetoacetal type, polyvinyl butyral type and polyester type resins are preferred with respect to migratability of the dye, etc., and further polyvinyl acetoacetal type, polyvinyl butyral type resins are particularly preferred.

The dye layer of the heat transfer sheet of the present invention can be formed basically from the above materials, but the specific feature of the present invention resides in incorporating a dye-permeative release agent in the dye layer thus formed.

As such release agent, all of known release agents used in the release paper, etc. in the prior art, which will not interfere with heat migration of the dye in the dye layer, can be used. The release agent which does not interfere with heat transfer of the dye in the dye layer can be easily chosen and used by preparing heat transfer sheets by use of various release agents and carrying out heat transfer tests.

Preferred in the present invention are silicone type compounds and phosphoric acid ester type surfactants. For example, as silicone compounds, there may be included silicone alkyd, silicone grafted polymer, alkyl modified silicone, fluorine fatty acid modified silicone, phenyl group containing silicone, fatty acid modified silicone, polyether modified silicone, silicone for release, surface bleed type silicone, etc., and among them, particularly preferred is fluorine fatty acid modified silicone. As phosphoric ester type compounds, for example, phosphoric acid ester sodium salts, etc. may be included.

Of these release agents, examples of the structures of particularly preferred silicone compounds may include the following.

Basic form

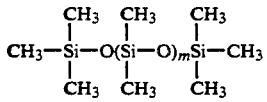

(m = 10 to 500)

α-Olefin modified silicone

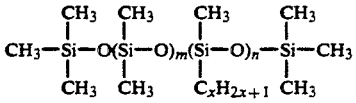

(m = 10 to 300, n = 10 to 300, x = 1 to 30)

Polyether modified silicone

-continued

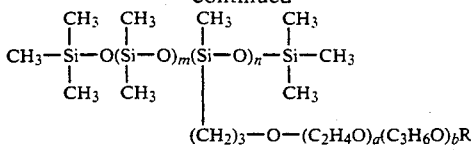

(m = 10 to 300, n = 10 to 300, a = 1 to 10, b = 1 to 10, R = alkyl group having 1 to 30 carbon atoms)

Fluorine fatty acid modified silicone

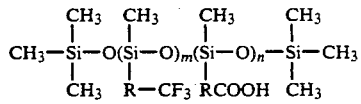

(m = 5 to 300, n = 5 to 300, R = alkylene group having 1 to 30 carbon atoms)

Fatty acid modified silicone

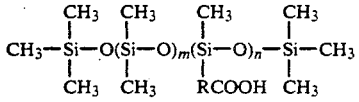

(m = 5 to 300, R = $C_{1-30}$ alkylene groups)

Fluorine modified silicone

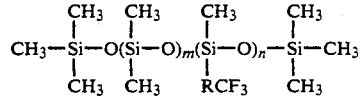

(m = 5 to 300, n = 5 to 300, R = alkylene group having 1 to 30 carbon atoms)

The content of the above release agent may be 0.1% by weight to 30% by weight based on the dye layer (dye and binder), preferably 0.1% by weight to 20% by weight. If it is added in excess of 30% by weight, the dye is liable to be agglomerated in the dye, whereby storability becomes undesirably bad. Most preferred among the combinations of the binder and the mold release agent is the combination of polyvinyl acetoacetal or polyvinyl butyral resin with fluorine fatty acid modified silicone.

Further, in the dye layer, other various additives similarly as known in the prior art can be included, if necessary.

Such a dye layer is formed preferably by adding the sublimable dye, the binder resin, the release agent and other optional components as described above in an appropriate solvent to have the respective components dissolved or dispersed therein, thus forming a coating material or ink for formation of dye layer, and then coating and drying this on the above substrate film.

The dye layer thus formed has a thickness of about 0.2 to 5.0 μm, preferably 0.4 to 2.0 μm, and the sublimable dye in the dye layer should be suitably present in an amount of 5 to 90% by weight, preferably 10 to 70% by weight, of the dye layer.

The dye layer formed may be formed by selecting one color from among the above dyes when the desired image is a mono-color, or when the desired image is a full-color image, for example, appropriate cyan, magenta and yellow (further black, if necessary) are selected to form a dye layer of yellow, magenta and cyan (further black, if necessary) as shown in FIG. 1.

The image-receiving material to be used for formation of image by use of the heat transfer sheet as described above may be any material of which the surface has dye receptivity for the above dye, and also in the case of paper, metal, glass, synthetic resin, etc. having no dye receptivity, a dye receiving layer may be formed on at least one surface thereof.

As the image-receiving material on which no dye receiving layer is required to be formed, there may be included, for example, fibers, fabrics, films, sheets, moldings, etc. comprising polyolefinic resins such as polypropylene, etc., halogenated polymers such as polyvinyl chloride, polyvinylidene chloride, etc., vinyl polymers such as polyvinyl acetate, polyacryl ester, etc., polyester type resins such as polyethylene terephthalate, polybutylene terephthalate, etc., polystyrene type resins, polyamide type resins, copolymer type resins of olefins such as ethylene, propylene, etc. with other vinyl monomers, ionomers, cellulosic resins such as cellulose diacetate, etc., polycarbonate, etc. Particularly preferred is a sheet or film comprising a polyester or a converted paper having a polyester layer provided thereon.

Also, in the present invention, even a non-dyeable image-receiving material such as paper, metal, glass and others can be made an image-receiving material by coating and drying a solution or dispersion of the dyeable resin as described above on its recording surface, or by laminating those resin films thereon. Further, even the above image-receiving material having dyeability may also form a dye-receiving layer from a resin with further better dyeability on its surface as in the case of the above paper.

The dye-receiving layer thus formed may be formed from a single material or a plurality of materials, and further various additives may be included therein within the range which does not interfere with the object of the present invention.

Such a dye-receiving layer may have any desired thickness, but generally a thickness of 2 to 50 μm. Also, such a dye-receiving layer may be preferably a continuous coating, but it may be also formed as non-continuous coating by use of a resin emulsion or a resin dispersion.

The means for imparting heat energy to be used in carrying out heat transfer by use of the above heat transfer sheet and the recording medium as described above, any imparting means known in the art can be used. For example, by means of a recording device such as thermal printer (e.g. Video Printer VY-100, manufactured by Hitachi K.K.), etc., by imparting a heat energy of about 5 to 100 mJ/mm$^2$, by controlling the recording time, a desired image can be formed.

According to the present invention as described above, the following effects can be exhibited by incorporating a mold release agent in the dye layer on the substrate film.

(1) The releasability between the dye layer and the image-receiving material becomes good during transfer, whereby the problem of transfer of the dye layer onto the image-receiving layer can be cancelled.

(2) Also, lowering in efficiency of heat utilization from the thermal head is minimal, whereby there ensues the advantage that an image having excellent image density, light resistance, and contamination resistance can be obtained.

The present invention is described in more detail below by referring to Examples and Comparative Examples. In the sentences, parts or % are based on weight unless otherwise particularly noted.

EXAMPLES AND COMPARATIVE EXAMPLES

As the substrate film, on the surface of a polyethylene-terephthalate film with a thickness of 6 μm applied with heat-resistant treatment on the back surface opposite to the surface where a dye layer is to be formed, the ink compositions for forming the dye layers of the three colors shown below were successively coated and dried by gravure coating to a coated amount on drying of 1.0 g/m$^2$ to prepare heat transfer sheets of the present invention and Comparative examples shaped in continuous films. The ink compositions used in Examples were completely uniform, and even when stored for one month under the temperature condition of 10° C., the inks became uniform without any precipitate or agglomerate being observed.

| | |
|---|---|
| Yellow color | |
| PTY-52 (manufactured by Mitsubishi Kasei, Japan, C.I. Disperse Yellow 141) | 5.50 parts |
| Polyvinyl butyral resin (manufactured by Sekisui Kagaku Kogyo, Japan, Ethlec BX-1) | 4.80 parts |
| Methyl ethyl ketone | 55.0 parts |
| Toluene | 34.70 parts |
| Release agent (Table 1 shown below) | 1.03 parts |
| Magenta color | |
| MS Red G (manufactured by Mitsui Toatsu, Japan, C.I. Disperse Red 60) | 2.60 parts |
| Macrolex Red Violet R (manufactured by Bayer, C.I. Disperse Violet 26) | 1.40 parts |
| Polyvinyl butyral resin (Ethlec BX-1) | 3.92 parts |
| Methyl ethyl ketone | 43.34 parts |
| Toluene | 43.34 parts |
| Release agent (Table 1 shown below) | 0.79 parts |
| Cyan color | |
| Kayaset Blue 714 (manufactured by Nippon Kayaku, Japan, C.I. Solvent Blue 63) | 5.50 parts |
| Polyvinyl butyral resin (Ethlec BX-1) | 3.92 parts |
| Methyl ethyl ketone | 22.54 parts |
| Toluene | 68.18 parts |
| Release agent (Table 1 shown below) | 0.94 parts |

Next, by use of a synthetic paper (manufactured by Oji Yuka, Japan, Yupo FPG150) as the substrate film, on one surface thereof was coated a coating solution with a composition shown below to a ratio of 4.5 g/m$^2$ on drying and dried at 130° C. for 3 minutes to obtain an image-receiving material to be used in the present invention and Comparative examples.

| | |
|---|---|
| Polyester resin (manufactured by Toyobo, Japan, Vylon 600) | 6.0 parts |
| Vinyl chloride-vinyl acetate copolymer (UCC, VAGH) | 14.0 parts |
| Amino-modified silicone oil (manufactured by Shinetsu Kagaku Kogyo, Japan, X-22-3050C) | 0.4 parts |
| Epoxy-modified silicone oil (manufactured by Shinetsu Kagaku Kogyo, Japan, X-22-3000E) | 0.4 parts |
| Methyl ethyl ketone | 20.0 parts |
| Toluene | 20.0 parts |

HEAT TRANSFER TEST

The heat transfer sheets of the above Examples and Comparative Examples were superposed on the above image-receiving material with the dye layer and the image-receiving layer opposed to each other, and thermal head recording was performed from the back surface of the heat transfer sheet by use of a thermal head (KMT-85-6, MPD2) under the conditions of a head application voltage of 12.0 V, an application pulse width in a step pattern which is successively reduced every 1 msec. from 16.0 msec./line, and a sub-scanning direction of 6 line/mm (33.3 msec./line).

As the result, as shown below in Table 1, in all the cases of Examples, the dye layer will not be migrated as such onto the image-receiving layer, and also releasability between the heat transfer sheet and the image-receiving material after recording was good. Also, the recorded image obtained exhibited sharp color formation.

TABLE 1

| Silicone compound | Manufacturer, Product No. | Mold releasability |
|---|---|---|
| Examples | | |
| Silicone alkyd | Shinetsu Kagaku KP-5206 | ○ |
| Silicone graft polymer | Toa Gosei Kagaku GS-30 | ○ |
| Silicone graft polymer | Toa Gosei Kagaku US-3000 | ○ |
| Phosphoric acid ester Na salt | Toho Kagaku Kogyo Gafak RE410 | ○ |
| Phosphoric acid ester | Ajinomoto Lecithin | ○ |
| Alkyl modified silicone | Shinetsu Kagaku KF412 | ○ |
| Fluorine fatty acid modified silicone | Shinetsu Kagaku SO-50450S | ◎ |
| Fluorine fatty acid modified silicone | Shinetsu Kagaku SO-11250S | ◎ |
| Fluorine fatty acid modified silicone | Shinetsu Kagaku TA-4230 | ◎ |
| Fluorine fatty acid modified silicone | Shinetsu Kagaku TA-88 | ◎ |
| Fluorine fatty acid modified silicone | Shinetsu Kagaku TA-30730 | ◎ |
| Fluorine fatty acid modified silicone | Shinetsu Kagaku X-24-3525 | ◎ |
| Phenyl group containing silicone | Shinetsu Kagaku KP-328 | ○ |
| Fatty acid modified silicone | Shinetsu Kagaku TA-6830 | ○ |
| Polyether modified silicone | Shinetsu Kagaku KF-352 | ○ |
| Silicone for mold release | Shinetsu Kagaku X-62-2087 | ○ |
| Surface bleed type silicone | Shinetsu Kagaku X-62-1215 | ○ |
| Comparative examples | | |
| Polyethylene wax | Microfine MF8F | ×× |
| No addition | | ×× |
| Aluminum chelating agent | Ajinomoto ALM | × |
| Titanium chelating agent | Nippon Soda TTS | × |

(Note)
◎ ; excellent ○; good ×; bad

From the results as described above, in all the cases of the heat transfer sheets of Examples, the dye layer was not migrated as such onto the image-receiving surface during printing, and also releasability between the heat transfer sheet and the image-receiving material during printing was good. Also, the recorded image was found to be good in all of printing density, light resistance and contamination resistance.

In contrast, in the case of Comparative Examples, the dye layer was peeled off to be migrated onto the image-receiving material at a considerable ratio, and also releasability between the transfer sheet and the image-receiving material during printing was not good.

What is claimed is:

1. A heat transfer sheet comprising:

a substrate film; and a dye layer formed on said substrate film, said dye layer comprising a dye, a binder, and a dye-permeative release agent comprising a flourine fatty acid modified silicone having the following formula (I):

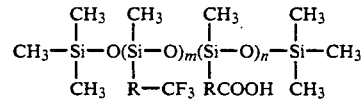

(I)

wherein M=5 to 300, n=5 to 300, and R=alkylene group having 1 to 30 carbon atoms.

2. The heat transfer sheet of claim 1, wherein said release agent is present in said dye carrying layer in an amount of 0.1–30 wt%.

3. A heat transfer sheet comprising:

a substrate film; and a dye layer formed on said substrate film, said dye layer comprising a dye, a binder, and a dye-permeative release agent comprising a fatty acid modified silicone having the following formula (II):

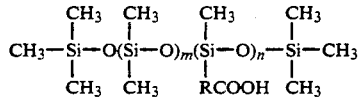

(II)

wherein m=5 to 300, and R=$C_{1-30}$alkyelene groups.

4. The heat transfer sheet of claim 3, wherein said release agent is present in said dye carrying layer in an amount of 0.1–30 wt%.

5. A heat transfer sheet comprising:

a substrate film; and a dye layer formed on said substrate film, said dye layer comprising a dye, a binder, and a dye-permeative release agent comprising a fluorine modified silicone having the following formula (III):

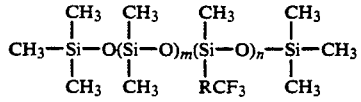

(III)

wherein m=5 to 300, n=5 to 300, and R=alkylene group having 1 to 30 carbon atoms.

6. The heat transfer sheet of claim 5, wherein said release agent is present in said dye carrying layer in an amount of 0.1–30 wt%.

* * * * *